United States Patent [19]

Cooley

[11] 4,342,266

[45] Aug. 3, 1982

[54] RAILROAD CAR TRUCK BOLSTER

[75] Inventor: Donald B. Cooley, Wheaton, Ill.

[73] Assignee: Standard Car Truck Co., Park Ridge, Ill.

[21] Appl. No.: 172,559

[22] Filed: Jul. 28, 1980

[51] Int. Cl.[3] ..... B61F 5/04; B61F 5/12; B61F 5/50

[52] U.S. Cl. ..... 105/226; 105/230

[58] Field of Search ..... 105/226, 230

[56] References Cited

U.S. PATENT DOCUMENTS

| | | | |
|---|---|---|---|
| 500,983 | 7/1893 | Westlake | 105/230 |
| 1,936,717 | 11/1933 | Johnson et al. | 105/230 |
| 1,957,570 | 5/1934 | Wolfe | 105/230 |
| 2,161,513 | 6/1939 | Hammerstrom | 105/226 |
| 4,067,261 | 1/1978 | Scheffel | 105/157 R |
| 4,067,262 | 1/1978 | Scheffel | 105/168 |
| 4,196,672 | 4/1980 | Bullock | 105/226 X |

*Primary Examiner*—Joseph F. Peters, Jr.
*Assistant Examiner*—Howard Beltran
*Attorney, Agent, or Firm*—Kinzer, Plyer, Dorn & McEachran

[57] ABSTRACT

A bolster for use in a railroad car truck has spring seat areas at the outer ends and a generally central section intermediate the spring seat areas and generally of substantially greater depth than the spring seat areas. A vertical reinforcing rib extends from the central section into the spring seat areas. The central section has slanted bottom walls which merge with the bottom walls of the spring seat areas. The spring seat areas and central section are subject to loading in opposite vertical directions thereby creating areas of localized bending stress at the junction of the spring seat bottom walls and the central section slanted bottom walls. The improvement of the present invention is specific to means for reducing such localized bending stress and includes vertical reinforcing rib means extending from the spring seat areas into the central section and being positioned on opposite sides of the vertical reinforcing rib. In addition, there is an opening in the vertical reinforcing rib in the area of said reinforcing rib means.

2 Claims, 3 Drawing Figures

RAILROAD CAR TRUCK BOLSTER

SUMMARY OF THE INVENTION

The present invention relates to bolsters for use in railroad car trucks and in particular to means for reducing the localized bending stress formed at the junction of the bottom walls of the bolster spring seat areas and the slanted walls of the bolster central section which adjoin thereto.

A primary purpose of the invention is a bolster of the type described which includes means for providing a dispersed increase in stiffness of the bolster in the area of the junction of the spring seats and the bolster central section.

Another purpose is a bolster in which the resistance to bending at the junction of the spring seats and the bolster central section is not localized, but is dispersed.

Another purpose is a bolster of the type described in which bending resistance at the spring seat and adjoining bolster central section is dispersed in both a longitudinal and a lateral direction.

Another purpose is a bolster structure of the type described which minimizes localized bending at the junction of the spring seat areas and the bolster central section slanted walls.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
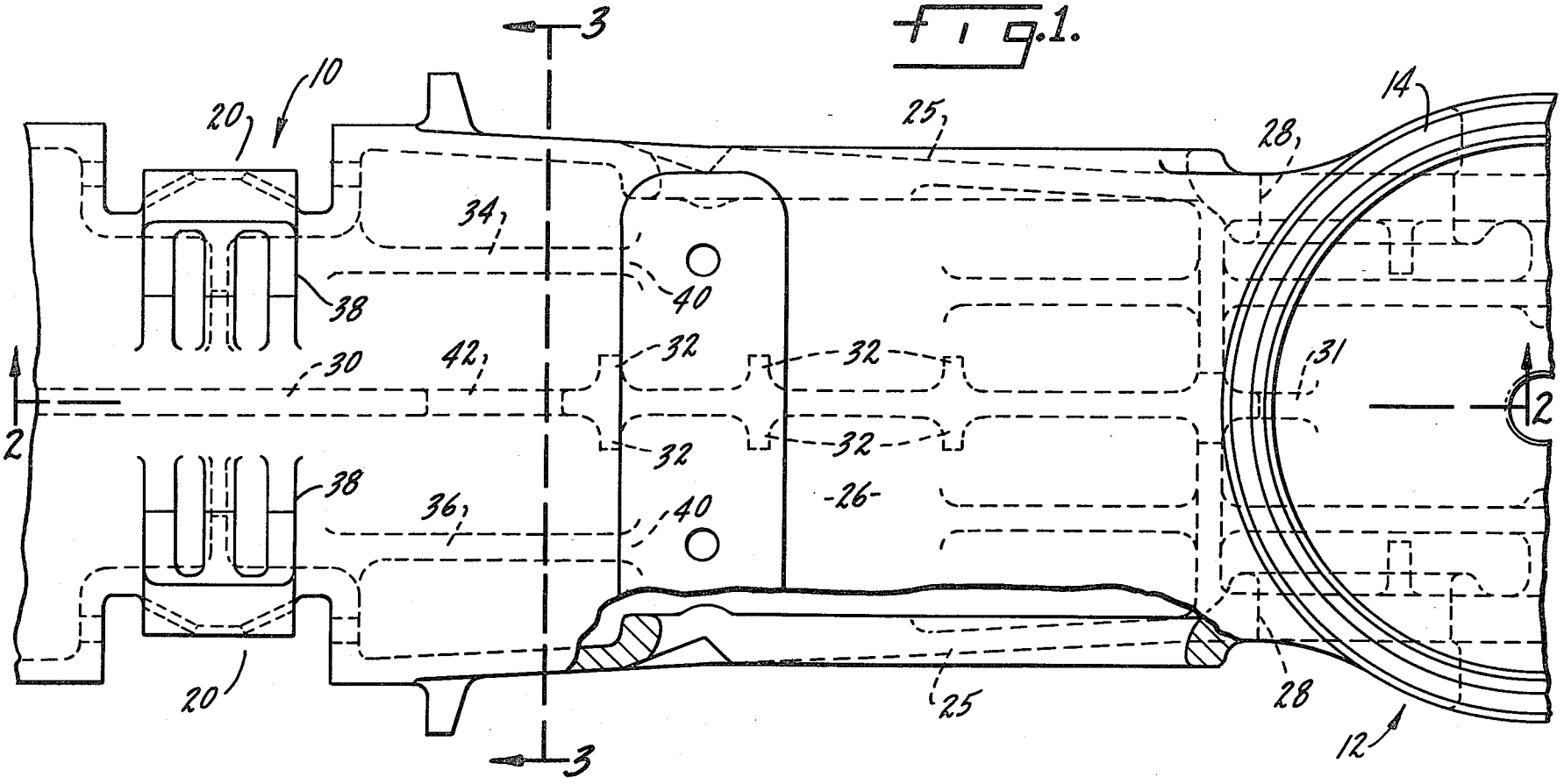
FIG. 1 is a top plan view of a portion of a railroad car truck bolster.
Figure 2:
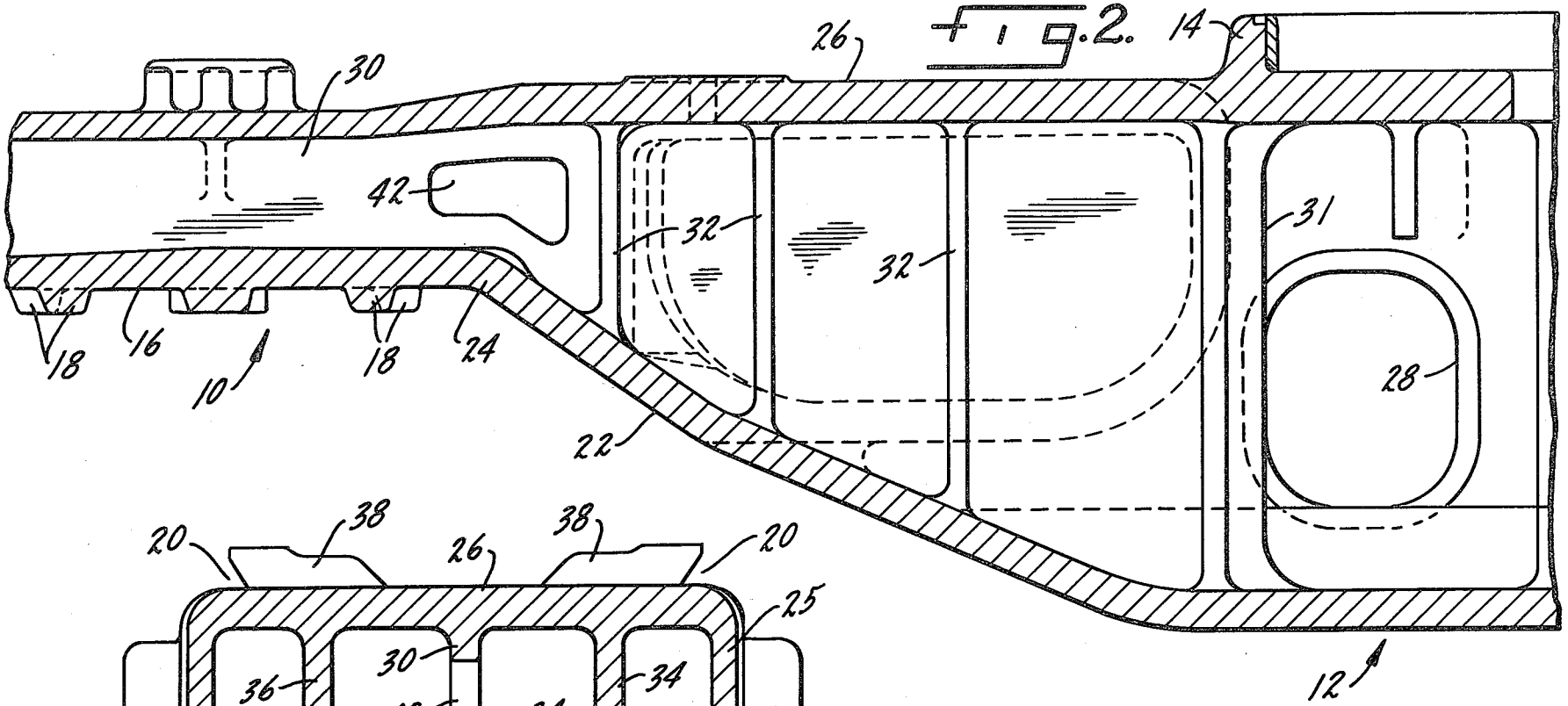
FIG. 2 is a section along plane 2—2 of FIG. 1.
Figure 3:
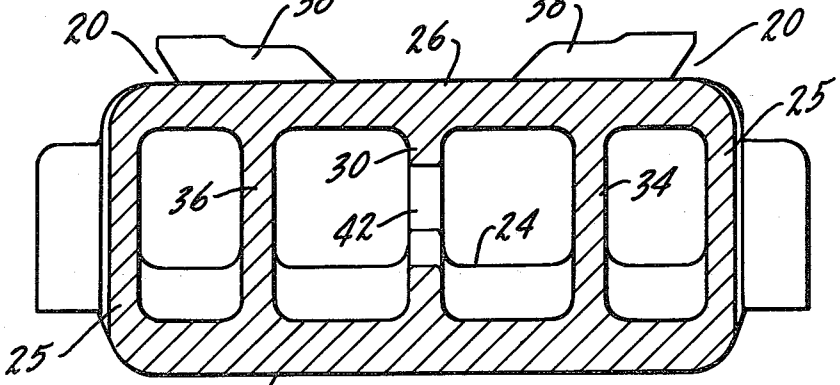
FIG. 3 is a section along plane 3—3 of FIG. 1.

The present invention relates to bolsters for railroad car trucks and is specifically concerned with the problem of localized bending stress at the junction of the spring seat areas of the bolster with the bolster central section. Because the spring seat areas must accomodate the bolster springs, these areas of the bolster must of necessity be substantially shallower than the generally central section of the bolster. The transition from a shallow section to a somewhat deeper section, normally including slanted bottom walls, creates an area of localized bending which has long been recognized by engineers in this field as a source for bolster fracturing and consequent damage. The problem is aggravated to some extent when the bolster is of the type which must have substantially large openings or windows in its central section side walls to accomodate anchors or rods which extend from one wheelset corner to the opposite, such rods being used to provide self-steering trucks. See U.S. Pat. Nos. 4,067,261 and 4,067,262. The windows in question must be of substantial vertical height to the point where they mandate an increase in the vertical dimension of the bolster center section. As indicated above, this aggravates the problem of localized bending.

Different solutions have been proposed for the problem of localized bending. At first it might be considered that increasing the metal thickness in the area of greatest stress would be a solution. This turns out not only to not be true, but in fact to aggravate the problem. By increasing the thickness of metal at the corners in question, there are increased surface stresses. Since the amount of additional metal is not itself sufficient to prevent bending, the increase in surface stress at this point will create a greater tendency for the bolster to fracture due to fatigue in this area.

The present invention specifically proposes to correct the problem of high localized bending stresses in the junction area of the spring seats and bolster central section by increasing the bending resistance or stiffness and by dispersing the increase over a substantial area. The increase in stiffness or the resistance to bending is spread out both longitudinally and laterally thereby providing substantial unlocalized resistance to bending and providing a bolster with a far less tendency to fracture at this critical point in its construction.

It should be understood that only portions of the bolster are shown herein, but the construction illustrated in the drawings is sufficient for one skilled in the railroad art to completely comprehend the invention.

As illustrated in the drawings, one of the bolster spring seat areas is indicated at 10 and a central section is indicated at 12. The top of the central section 12 includes the conventional center plate rim 14 where the bolster will support the body bolster of the car. The bottom wall of the spring seat area 10, indicated at 16, includes several spring bosses 18 which will position the top of the conventional bolster springs, not shown herein.

As is conventional in freight car trucks which have means for dampening relative movement between the bolster and side frame, there are wedge pockets, indicated at 20, facing outwardly from each side of the bolster in the spring seat area. The pockets will conventionally position a wedge-shaped element, commonly called a friction wedge or friction casting, which will be urged by a spring against an adjoining surface of the side frame.

The bottom wall 16 of the spring seat area joins a downwardly-slanted bottom wall 22 of the central section 10 with the junction being formed at a corner 24 which, as described above, is the location of severe localized bending stresses in the bolster structure.

The bolster central section may have outer side walls 25 which will conventionally join the slanted bottom walls 22 of the central section and a top wall 26 which extends generally continuously across the bolster. There are large openings 28 positioned in side walls 24 and these openings must be of a sufficient size, in particular types of trucks, to accommodate what is known in the trade as cross anchors or rods which extend from one wheelset to the opposite corner of the other wheelset. Since the bolster will have substantial vertical movement relative to the wheels during use of the truck, the openings 28 must be of a size to permit vertical movement of the bolster relative to the rods.

Looking specifically at FIG. 1, there is a reinforcing rib 30 generally centrally positioned in the bolster and which extends from an area 31 adjacent the center plate rim 14 outwardly into the area of the spring seat. Rib 30 is discontinuous in the bolster center area to accomodate the above-described cross anchors. It will also have a series of outwardly or laterally extending rib sections 32, the purpose of which is described in detail in U.S. Pat. No. 4,196,672.

As described above, the spring seat areas will have upwardly-directed forces thereupon and the center of the bolster will have a downwardly-directed force. These oppositely-directed forces must be supported by the bolster in the manner generally characterized as a "simply supported beam with intermediate load." This load causes a beam bending moment which increases from zero at the ends to a maximum in the region of the intermediate load. In addition, there is a shear load which is generally constant between the end support and the intermediate load. This shear load can cause local bending of the top and bottom of the bolster and shearing of the rib and outside walls in the region of minimum beam strength, that being the region of the intersection of the horizontal bottom wall and the slanted bottom wall. Insufficient resistance to shearing in the rib and outside vertical surface permits the local bending of the top and bottom surfaces. Under this condition, the structure is not performing as a beam. The presence of the cross anchor holes in the outer wall in the region near the spring seats causes the structure to deflect in the manner of a truss rather than that of a beam. The presence of the solid center rib 30 in this region promotes interaction of the top and bottom and the rib in the manner of a beam, but there is insufficient shear strength in the rib to perform this function satisfactorily. In addition, this causes distortion of the top and bottom horizontal surfaces in a lateral direction, increasing the local stresses.

Two changes in structure have been utilized to reduce localized bending stress as described. The first is the addition of two vertical ribs, indicated at 34 and 36, which extend between the bolster top and bottom walls and which may be spaced equally on opposite sides of rib 30. Ribs 34 and 36 will extend from the inboard side 38 of the bolster wedge pocket to an area 40 generally coextensive with the first of the reinforcing rib sections 32. Ribs 34 and 36 by joining the top and bottom walls attempt to provide a beam-like construction and thereby reduce the described localized bending stresses. Addition of these two additional reinforcing ribs substantially reduces the localized bending at the region in question, but the necessary abrupt termination of these ribs at the inboard side of the bolster pocket creates a different region of minimum beam stiffnesses and results in localized bending stresses in the top and bottom surfaces at the inboard side of the bolster pocket. Accordingly, it is necessary to reduce the resistance to bending in central rib 30 by the addition of opening 42. Such an opening tends to weaken the central rib. Thus, ribs on either side of the central rib together with opening 42 provide an area which is more gradually resistant to bending or provides a dispersed stiffness at the location where the spring seats join the bolster central section.

In addition to providing the above-described longitudinal reduction in localized stresses, by weakening the central rib and by providing strength in the form of two additional ribs on either side of the central rib, there is a dispersed resistance to a twisting of the spring seat relative to the bolster central section. Thus, the stresses in a lateral direction have also been dispersed over a larger area.

Whereas the preferred form of the invention has been shown and described herein, it should be realized that there may be many modifications, substitutions and alterations thereto.

The embodiments of the invention in which as exclusive property or privilege is claimed are defined as follows:

1. A bolster for use in a railroad car truck including spring seat areas at outer ends and a generally central section intermediate spring seat areas and of substantially greater vertical dimension than the spring seat areas, each of said spring seat areas including a pair of pockets positioned on opposite sides of the bolster for positioning a dampening wedge, a vertical reinforcing rib extending from the central section into the spring seat areas, the central section having slanted bottom walls which merge with bottom walls of the spring seat areas, the spring seat areas and central section being subject to loading in opposite vertical directions thereby creating areas of localized bending stress at the spring seat junction of the bottom walls and central section slanted bottom walls, the improvement comprising means for reducing such localized bending stress including separate ribs on each side of said vertical reinforcing rib and generally equally spaced therefrom, said separate ribs beginning generally inboard of a bolster wedge pocket and extending toward and terminating substantially short of the central section of said bolster, and an opening in said vertical reinforcing rib extending longitudinally through a portion of said vertical reinforcing rib, from the central section and terminating short of ends of said separate ribs.

2. The bolster of claim 1 further characterized in that the generally central section of said bolster includes vertically extending outer side walls, an opening in said side walls of a size and shape to permit wheelset steering rods to extend therethrough.

* * * * *